US009218702B2

(12) United States Patent
Bird et al.

(10) Patent No.: US 9,218,702 B2
(45) Date of Patent: Dec. 22, 2015

(54) CURRENCY ACCEPTOR, SECURITY DEVICE AND METHOD

(71) Applicant: Astrosys International Ltd, Kowloon (HK)

(72) Inventors: Robert Bird, Burwood (AU); Ivan Radojkovic, Southbank (AU)

(73) Assignee: Astrosys International Ltd., Kowloon (HK)

( * ) Notice: Subject to any disclaimer, the term of this patent is extended or adjusted under 35 U.S.C. 154(b) by 2 days.

(21) Appl. No.: 14/225,257

(22) Filed: Mar. 25, 2014

(65) Prior Publication Data

US 2015/0279146 A1 Oct. 1, 2015

(51) Int. Cl.

| | |
|---|---|
| ***G07D 7/00*** | (2006.01) |
| ***G07F 1/04*** | (2006.01) |
| ***G07D 11/00*** | (2006.01) |

(52) U.S. Cl.

CPC ..... *G07F 1/041* (2013.01); *G07D 11/0018* (2013.01)

(58) Field of Classification Search

CPC ..... G07F 1/041; G07F 1/042; G07F 1/043; G07F 1/044; G07F 1/06; G07F 1/02; G07F 1/04; G07F 7/04; G07F 7/02; G07F 7/0609; G07F 9/06; G07D 5/00; G07D 5/08; G06Q 20/3433; B30B 9/325; G06K 7/065; A45C 1/12

USPC ..... 194/203, 208, 209; 232/62

See application file for complete search history.

(56) References Cited

U.S. PATENT DOCUMENTS

| | | | | |
|---|---|---|---|---|
| 5,259,490 | A | 11/1993 | Gardellini | |
| 5,325,952 | A | 7/1994 | McGinley et al. | |
| 5,494,144 | A | 2/1996 | Izawa | |
| 5,642,801 | A | 7/1997 | Burson, Jr. | |
| 6,021,881 | A | 2/2000 | Wild | |
| 6,877,599 | B2 | 4/2005 | Pai | |
| 6,991,083 | B2 | 1/2006 | Yoshioka et al. | |
| 8,499,917 | B2 | 8/2013 | Smith | |
| 2004/0149537 | A1 * | 8/2004 | Pai | 194/203 |
| 2005/0224311 | A1 * | 10/2005 | Tsai | 194/203 |

* cited by examiner

*Primary Examiner* — Jeffrey Shapiro

(74) *Attorney, Agent, or Firm* — Hinshaw & Culbertson LLP

(57) ABSTRACT

A device and method for preventing fraudulent withdrawal of a bill from a bill acceptor after credit has been given. The device includes a cash box, a punch plate and a security device. The security device includes at least one bill-cutting edge and at least one string-cutting surface. A method uses a security device to cut a bill when a fraudulent withdrawal of the bill is attempted.

25 Claims, 8 Drawing Sheets

Fig. 4
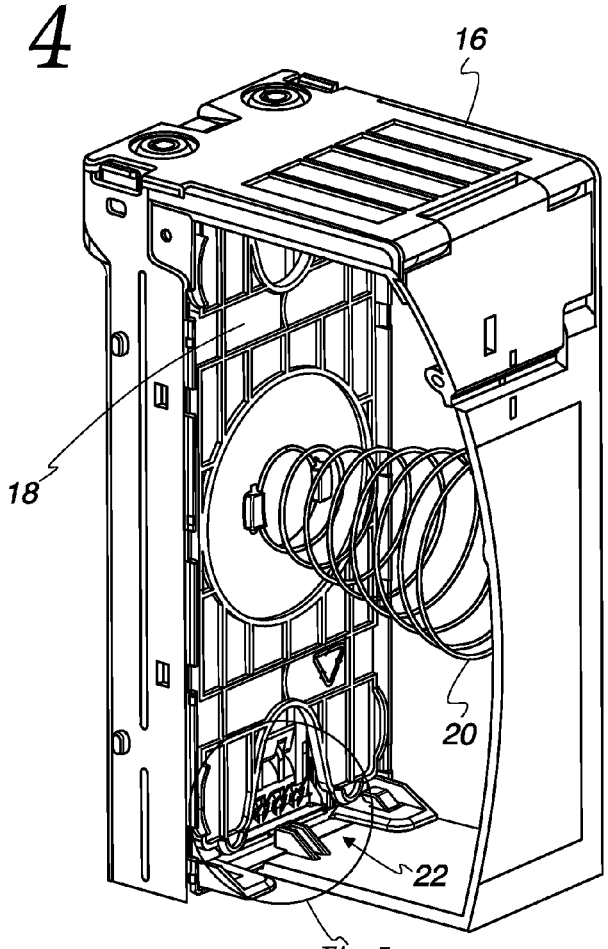
Fig. 5
Fig. 5
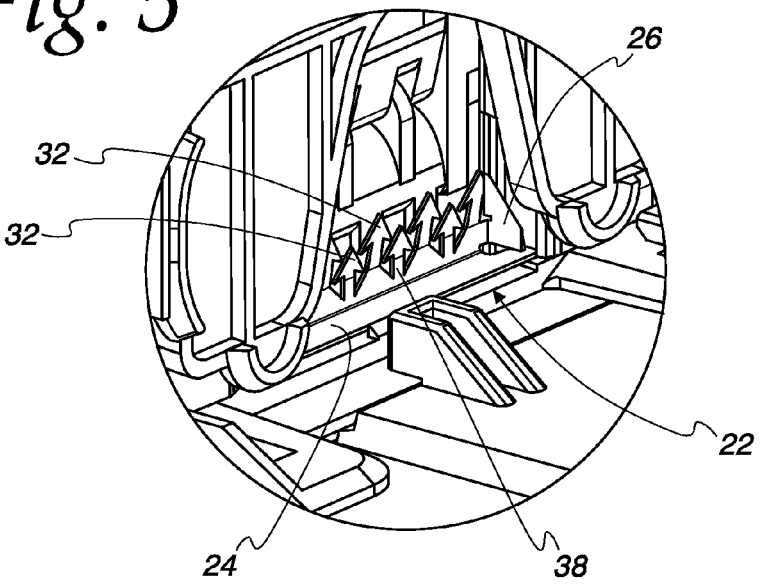

CURRENCY ACCEPTOR, SECURITY DEVICE AND METHOD

FIELD OF THE INVENTION

The present invention relates generally to currency (or bill) acceptors, and more particularly, to security devices and methods that reduce or eliminate fraud perpetrated by unscrupulous individuals who insert a bill into a bill acceptor and, after receiving credit therefor, withdraw the bill.

BACKGROUND OF THE INVENTION

Bill acceptors have become ubiquitous in today's world. Various types of bill acceptors can be found, for example, on gaming machines, vending machines and change machines. In a conventional bill acceptor, a consumer inserts a bill into a horizontal slot. The bill acceptor draws in the bill to analyze whether it should validate the bill. If the bill acceptor is unable to validate the bill, the bill acceptor pushes the bill back out to the consumer, without giving any credit for the bill. If the bill acceptor validates the bill, it passes the bill on for stacking with other previously validated bills in a cash box. It also credits the consumer for the bill, allowing the consumer to play a game, purchase a product, receive change, etc.

It has been learned that some consumers attempt to defraud bill acceptors by withdrawing their bills after having received credit for them. One common ploy, sometimes called "stringing," involves using a very fine "string," such as fishing line. The fishing line is used by fraudulent consumers because it is thin enough that it may not be detected by the bill acceptor's optical sensors. The fraudulent consumer attaches a double layer of transparent tape across the length of a bill and attaches the fine fishing line to the bill with the tape. The tape is transparent so that it will not prevent the bill acceptor from locating the required images on the bill for validation. After the bill is validated by the bill acceptor and stacked in the cash box, the consumer pulls the string back through the bill acceptor. The double layer of tape unfolds from the bill. When the fraudulent consumer can reach the tape, he then pulls on the tape and recovers the bill. Thus, the consumer receives credit for the bill without actually giving the bill to the machine operator.

Using video and security guards is an expensive way to try to prevent this fraud. A security guard monitoring the situation on a real-time basis is likely too expensive. Although reviewing past video surveillance only if and when a problem is discovered is less expensive, it is unlikely to catch each fraudulent transaction. Even if such a system did discover a past fraudulent transaction, the perpetrator is likely long gone by the time the problem has been reviewed on video.

Deterrents within the bill acceptor itself might seem to hold more promise, but until now, such systems have been less than satisfactory. A need exists for an effective device and method to discourage and prevent fraudulent use of bill acceptors.

BRIEF SUMMARY OF THE INVENTION

The present invention in one embodiment is a device for accepting bills and for preventing fraudulent withdrawal of a bill by a consumer that includes a cash box that defines a first slot for receiving a bill and a platen positioned to receive the bill from the first slot. A punch plate moves the bill from a first position in the first slot to a second position closer to the platen. A security device is located between the first position and the second position. The security device has at least one string-cutting surface and at least one bill-cutting edge. At least a part of the at least one bill-cutting edge is located closer to the second position than is the at least one string-cutting surface. In this way, the at least one bill-cutting edge cuts the bill on attempted unauthorized withdrawal.

In one embodiment, when the bill is withdrawn from the second position, the bill contacts the bill-cutting edge prior to contacting the string-cutting surface. The at least one bill-cutting edge can be on at least one bill cutter. The at least one bill-cutting edge can be angled to contact substantially perpendicularly the bill being fraudulently withdrawn from the second position.

In one embodiment, the device can include two or more bill cutters, with each bill cutter including a bill-cutting edge that is angled to contact substantially perpendicularly the bill being fraudulently withdrawn from the second position. The at least one string-cutting surface can be positioned between the two bill cutters.

The at least one string-cutting surface can be angled away from the first position and angled toward the second position. In one embodiment the device can include a substantially planar string-cutter base portion integral with the at least one string-cutting surface. The string-cutting surface can include a plurality of string cutters angled from the string-cutter base portion.

Each of the plurality of string cutters can be arrow-shaped, having a point at a distal end from the string-cutter base portion. The string cutter can be in a staggered orientation such that at least one string cutter extends further from the string-cutter base portion than a first adjacent string cutter on a first side of the at least one string cutter and further from the base portion than a second adjacent string cutter on a second side.

The device can include a bill acceptor attached to the cash box and defining a second slot for receiving a bill. The second slot can be substantially horizontal, while the first slot can be substantially vertical. The first slot and the second slot are in communication such that a bill passes from the second slot to the first slot.

In one embodiment, the platen is biased toward the first slot. The platen can have a front surface and a rear surface. A spring located on the rear surface can bias the platen toward the first slot.

The security device can be positioned such that a bill moving from the first position to the second position passes over the security device.

In another embodiment of the present invention, a device receives bills for validation. The device includes a housing defining a slot or other opening dimensioned to allow a consumer to insert a bill for validation. A cash box downstream from the slot includes structure for stacking a plurality of validated bills. The device also includes structure for preventing fraudulent withdrawal of an intact validated bill from the cash box, the structure cutting the bill to render it unusable during an attempted withdrawal from the device. The device may further include structure for cutting a string that is attached to the bill.

Another aspect of the present invention is a method for preventing fraudulent withdrawal of a bill from a bill acceptor after credit has been given therefor. The method is typically used with any of the bill acceptors as described above that includes a bill security device housed therein that includes at least one bill-cutting edge. In the inventive method, the bill acceptor receives a bill, validates it and gives a consumer credit. The acceptor moves the bill into a first position in a slot. The bill is then moved over the bill security device and into a second position. When a fraudulent withdrawal of the bill from the second position is attempted, the acceptor cuts the bill with the at least one bill-cutting edge during movement of the bill in a direction out of the device. One embodiment of the method has a bill security device that also includes at least one string-cutting surface and includes the step of cutting a string attached to the bill when a fraudulent withdrawal of the bill from the second position is attempted.

In another aspect of the invention, a bill security device is provided. The security device can be mounted along a bill withdrawal pathway in a bill acceptor. The security device prevents fraudulent withdrawal of a bill inserted by a consumer. The security device has a mounting member for mounting the security device along the bill withdrawal pathway. The security device also includes a bill cutting edge extending from the member. The bill cutting edge can be positioned to protrude into the bill withdrawal pathway for longitudinally cutting a bill travelling along the withdrawal pathway.

The security device can further include a second bill cutting edge spaced from the first bill cutting edge and extending from the mounting member along the bill withdrawal pathway for longitudinally cutting the bill in a different location from the first bill cutting edge. The security device can also include a plurality of string cutting elements extending from the mounting member and in a direction generally opposed to the direction of a bill being removed along the withdrawal pathway.

BRIEF DESCRIPTION OF THE DRAWINGS

FIG. 4 is a perspective view of the cash box of FIG. 3 with a portion removed to show a bill security device in accordance with the present invention;

FIG. 5 is an enlarged, perspective view of a bill security device in accordance with the present invention taken from circle 5 of FIG. 4;

DETAILED DESCRIPTION OF THE INVENTION

Figure 1:
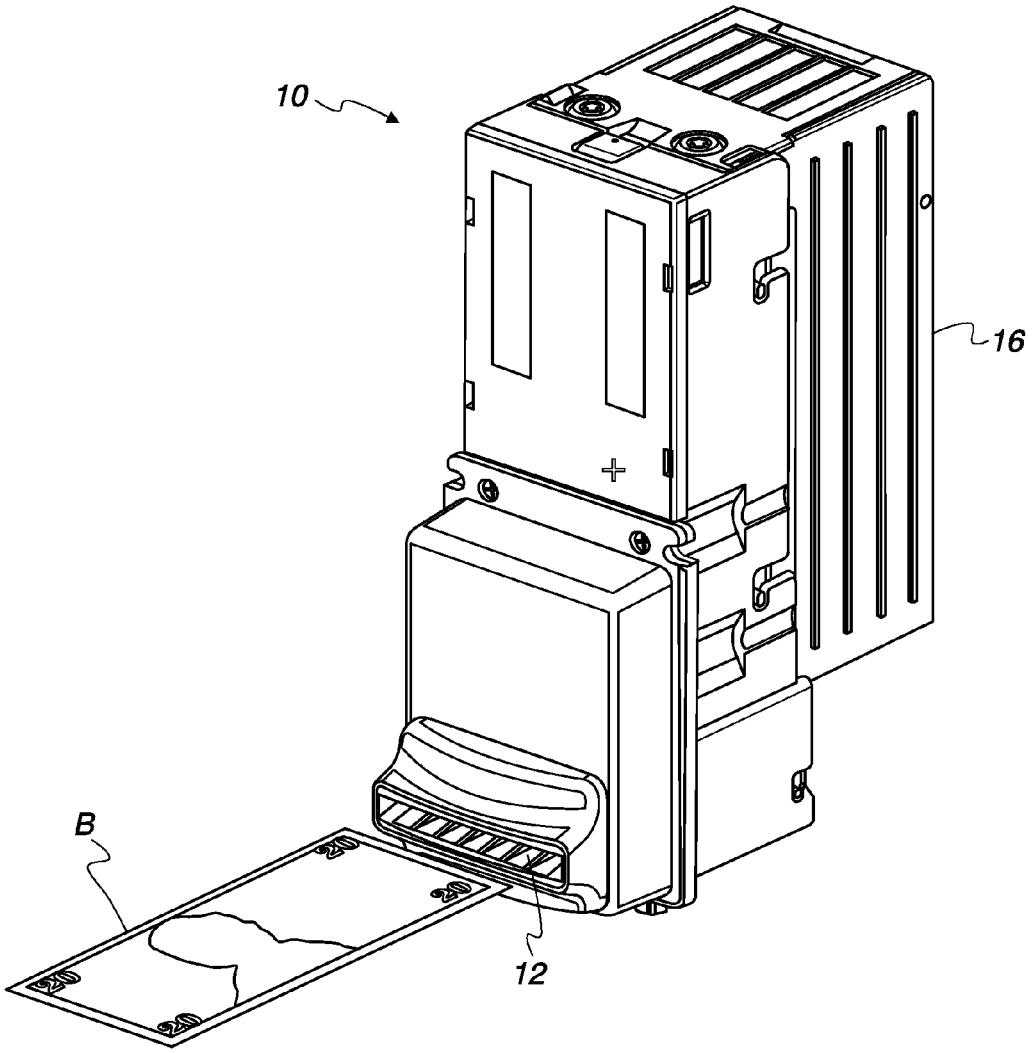
FIG. 1 is a front perspective view of a bill acceptor in accordance with the present invention.

Referring first to FIG. 1, there is shown a bill acceptor 10 in accordance with the present invention. Much of bill acceptor 10 works in the conventional manner and will be already understood to one of ordinary skill in the art. The primary modification to bill acceptor 10 herein relates to a bill security device 22, as explained below.

Bill acceptor 10 includes on the front thereof a slot 12, which can be generally horizontal for ease of insertion of a bill B by a consumer. Although bill B is shown as being U.S. currency, it is to be understood that bill B can be made from a variety of thin paper, paper-like or polymer materials that are used to create objects that are treated as having value. Thus, in addition to being currency from the U.S. or elsewhere, bill B also may be a coupon, voucher, check or other holder of value.

Figure 2:
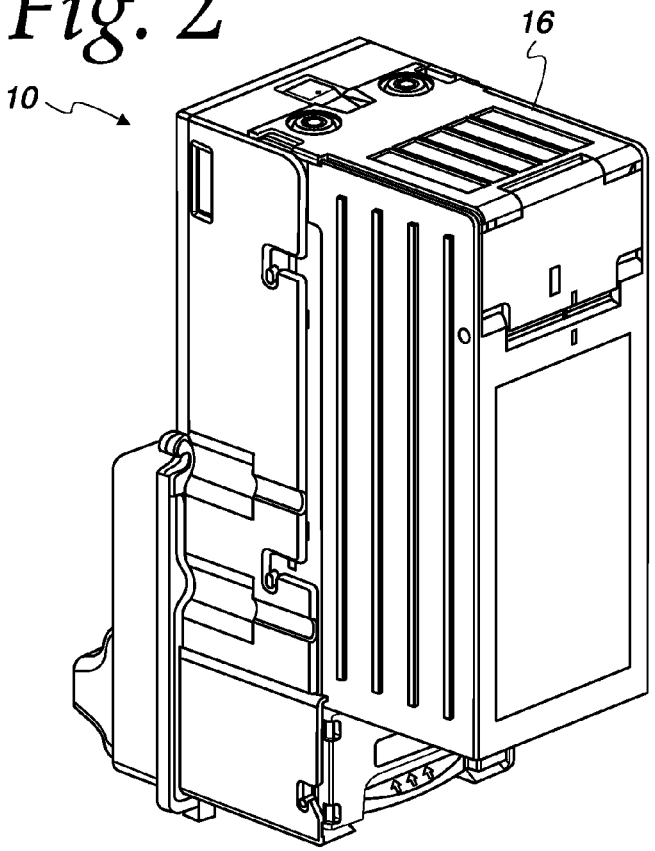
FIG. 2 is a rear perspective view of the bill acceptor of FIG. 1.
Figure 3:
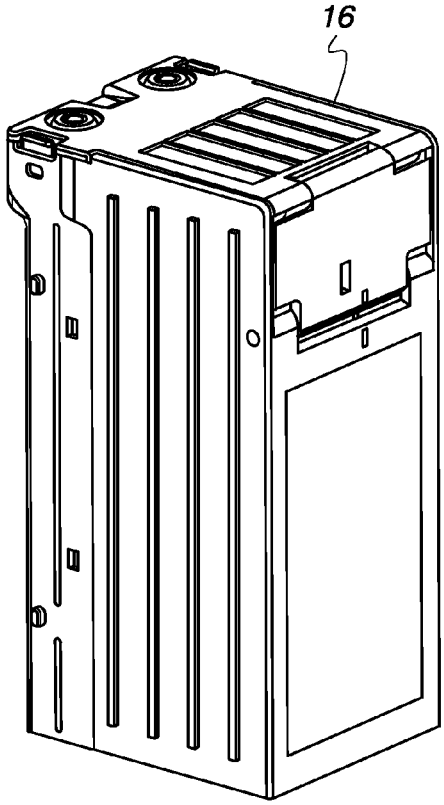
FIG. 3 is a perspective view of a cash box shown in FIG. 2.

A rear portion of bill acceptor 10 is formed by a cash box 16, as more clearly shown in FIG. 2. FIG. 3 depicts cash box 16 separated from the remainder of bill acceptor 10. FIG. 4 shows a partial cutout of cash box 16 allowing a view into its interior. FIG. 5 provides an enlarged view thereof. Of importance for purposes of illustrating an embodiment of the present invention, cash box 16 includes a platen 18, a spring 20 and a bill security device 22.

As most clearly seen in FIGS. 10-14, bill security device 22 includes a flange 24, a pair of bill cutters 26 and a string-cutting surface 28. Bill cutters 26 are designed to cut bill B if a consumer attempts to fraudulently withdraw bill B. String-cutting surface 28 is separate from bill cutters 26 and is designed to cut, or at a minimum, entangle, any string or tape attached to bill B if a consumer attempts to fraudulently withdraw bill B. Because bill cutters 26 and string-cutting surface 28 are separate, they can each be designed to maximize their performance for their particular jobs.

Bill security device 22 can be made of steel. Flange 24 can be about 50 mm by 4 mm. For comparison purposes, U.S. currency is about 65 mm wide. Thus, bill cutters 26 are positioned to slice a portion of bill B if bill B is being fraudulently withdrawn. Each bill cutter 26 has a bill-cutting edge 30 that is sharp enough to slice bill B. In a preferred embodiment, bill security device 22 includes two bill cutters 26, each having a bill-cutting edge 30. The two bill-cutting edges 30 can be located symmetrically about the central axis of cash box 16. Bill-cutting edge 30 can be angled with respect to flange 24 so that bill-cutting edge 30 preferably will contact bill B at a substantially perpendicular angle if bill B is being fraudulently retrieved by a consumer. Bill-cutting edge 30 also may contact bill B at a different angle so long as bill-cutting edge 30 cuts bill B.

Figure 7:
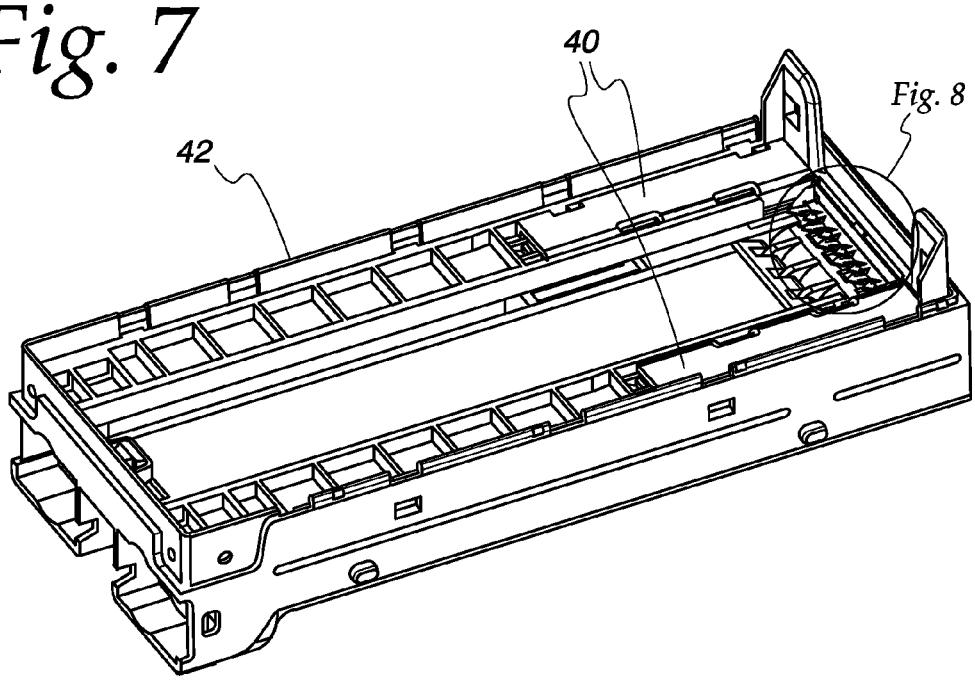
FIG. 7 is a perspective view of a bill guide sub-assembly of the bill acceptor of FIG. 1.
Figure 8:
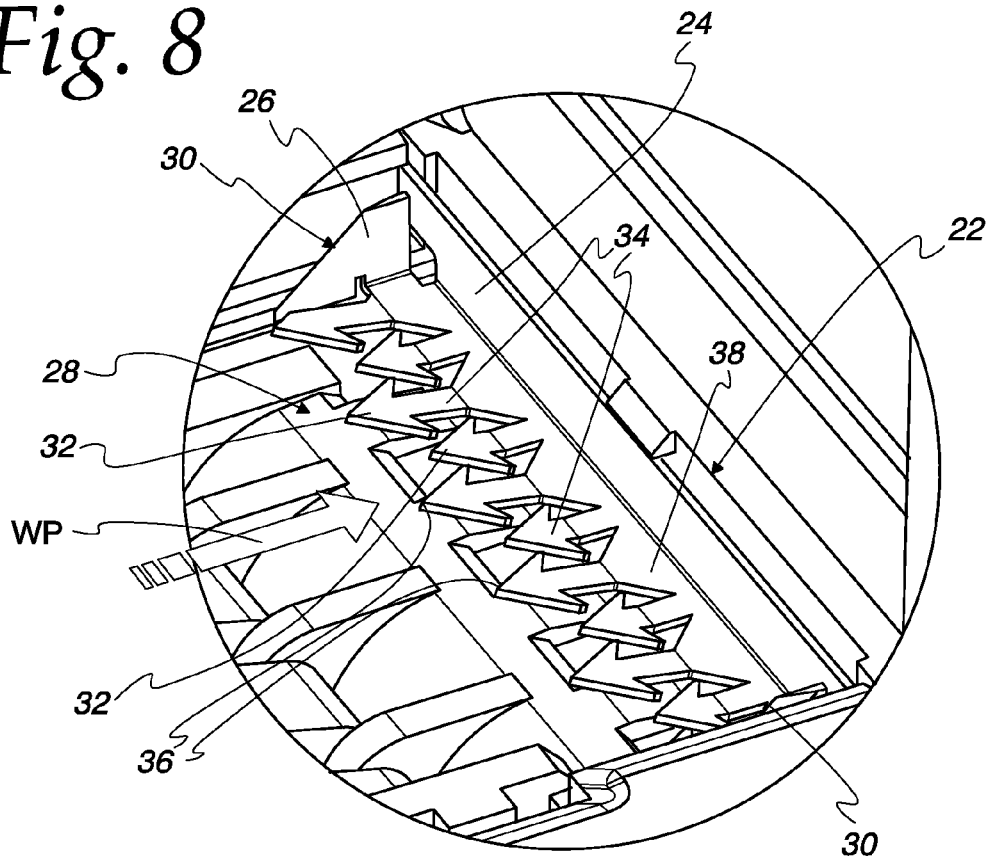
FIG. 8 is an enlarged, perspective view of a bill security device of the bill acceptor of FIG. 1 taken from circle 8 of FIG. 7.
Figure 9:
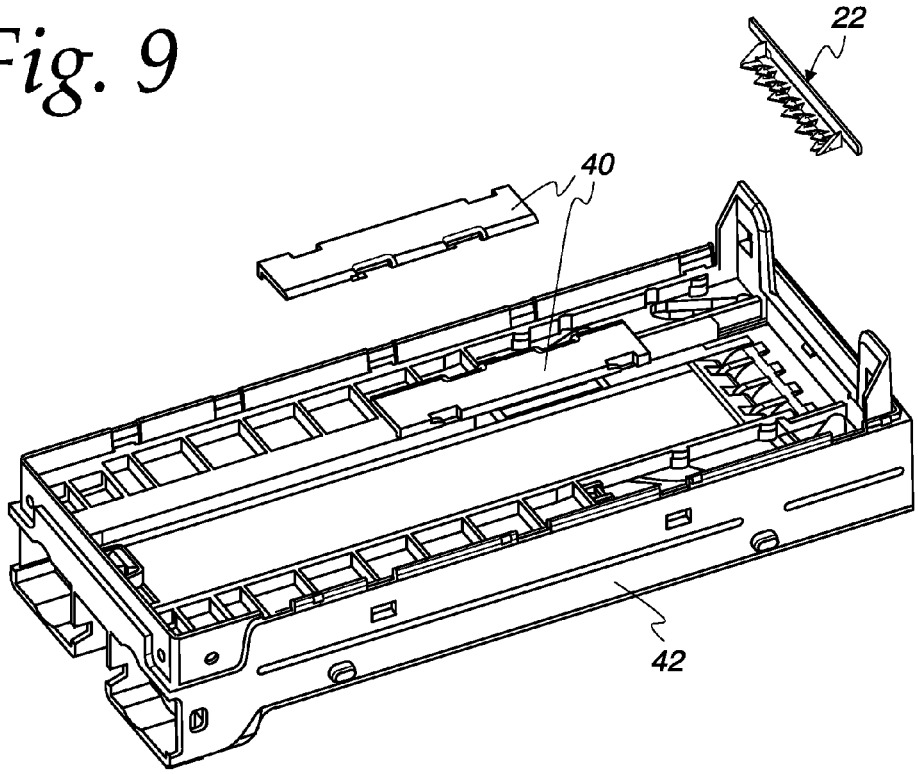
FIG. 9 is a partially exploded view of the bill guide sub-assembly of FIG. 7.
Figure 10:
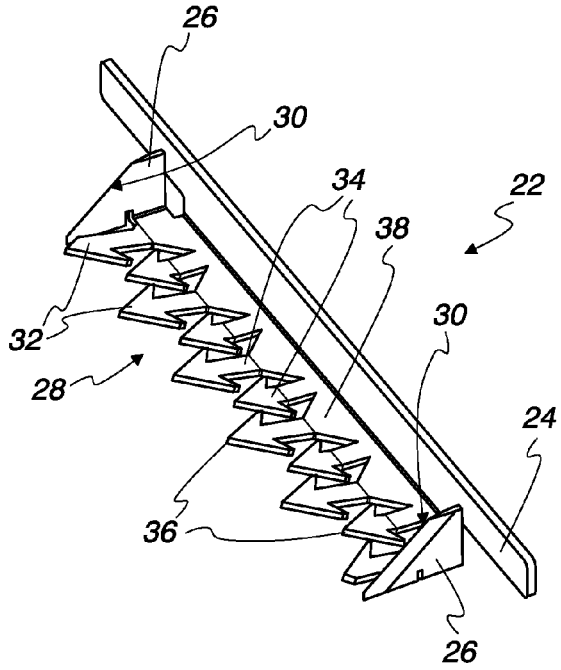
FIG. 10 is an enlarged, top perspective view of the bill security device of FIG. 8.
Figure 11:
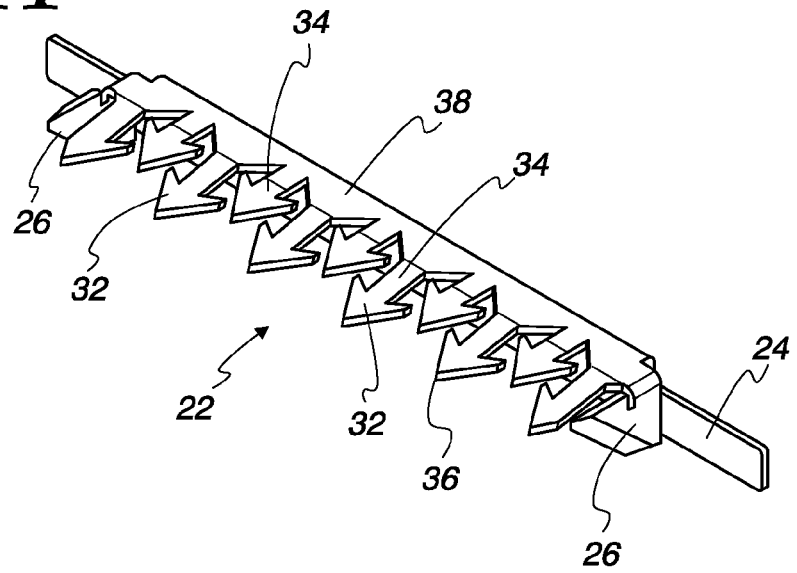
FIG. 11 is an enlarged, bottom perspective view of the bill security device of FIG. 8.
Figure 12:
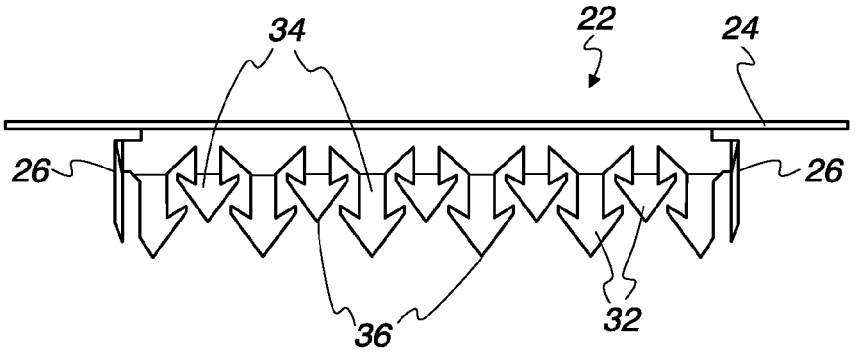
FIG. 12 is a top plan view of the bill security device of FIG. 8.
Figure 13:
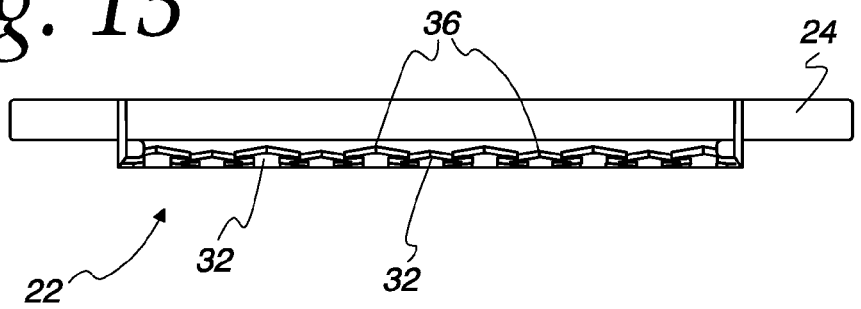
FIG. 13 is a front plan view of the bill security device of FIG. 8.
Figure 14:
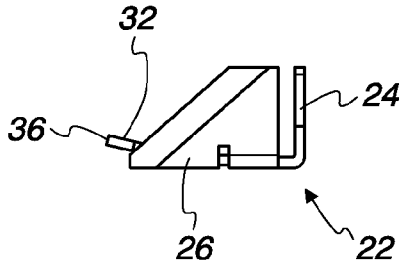
FIG. 14 is a side plan view of the bill security device of FIG. 8.

String-cutting surface 28 is preferably positioned between bill cutters 26. In one preferred embodiment, string-cutting surface 28 includes a plurality of arrow-shaped string cutters 32. Each string cutter 32 can include a stem 34 and a point 36. Stem 34 is integral with a substantially planar, string cutter base portion 38. Beginning at stem 34, string cutter 32 is angled with respect to the plane of base portion 38. String cutters 32 can have varying lengths, preferably alternating between two lengths as shown in the Figures. The longer string cutters 32 can extend further from flange 24 than cutters 26 as shown in FIGS. 12 and 14. Bill security device 22 can have a height 52 (FIG. 12) from flange 24 to point 36 of 8 mm. As shown in FIGS. 7 and 9, bill security device 22 can be held in place by a pair of bill guide covers 40 within a bill guide sub-assembly 42. Bill guide covers 40 and string cutters 32 also serve to guide bill B onto bill cutting edges 30 when a consumer attempts to fraudulently withdraw bill B. FIG. 8 provides an enlarged view of bill security device 22 within bill guide sub-assembly 42.

Figure 6:
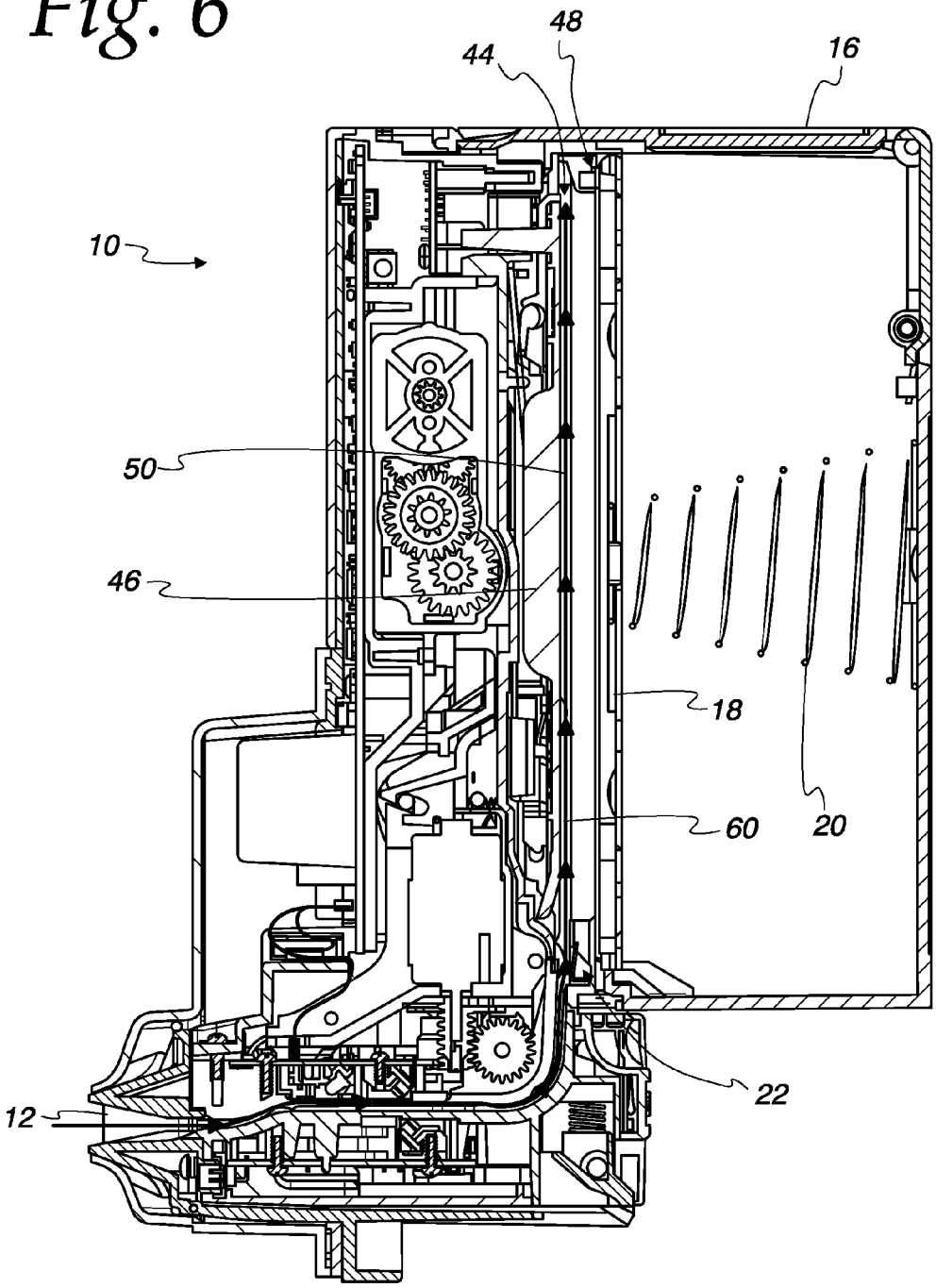
FIG. 6 is a sectional view of the bill acceptor of FIG. 1.

In operation, a consumer inserts a bill B into slot 12. Bill B is drawn into bill acceptor 10 in a conventional manner. Bill acceptor 10 attempts to validate bill B. If bill acceptor 10 is not able to validate bill B, bill B is returned to the consumer via slot 12. If bill B is successfully validated, it will be driven up into a slot 50, which can be substantially vertical, in a first position 44 just to the left of bill security device 22 as they are depicted in FIG. 6. Thus, bill B travels along a bill pathway 60 in the direction of arrows shown in FIG. 6. A punch plate 46 then moves bill B from first position 44 to a second position 48. At this point, the consumer is credited for bill B. Second position 48 is to the right of bill security device 22 as they are depicted in FIG. 6. As shown in FIG. 6, in position, string cutters 32 are angled toward second position 48 of bill B, i.e., points 36 of string cutters 32 are not vertical, but rather are angled to point toward second position 48, as opposed to first position 44 of bill B. Bill-cutting edges 30 also face toward second position 48 of bill B, as opposed to first position 44 of bill B. Bill B passes across bill security device 22 by going over it. The angling of string cutters 32 toward second position 48 facilitates this movement. Bill B is placed against platen 18 or against the most recently stacked bill B already on platen 18. Thus, platen 18 is used for stacking a plurality of validated bills B. The consumer is given credit for bill B toward a transaction and may now play a game, purchase a product, receive change, etc.

It should be noted that the present invention can also be used with a slot 50 that is at a different angle than substantially vertical. For example, slot 50 can be substantially horizontal. Bill entry in slot 12 can still be horizontal, but if slot 50 is horizontal, there would not need to be any bend in the path of bill B from entry at slot 12 to positioning in slot 50. Cash box 16 would correspondingly be oriented in a horizontal manner in that embodiment.

Bill security device 22 comes into play if bill B has been modified by having, for example, a piece of tape T attached thereto, with a piece of string attached to tape T and extending away from bill B all the way out through slot 12 where the fraudulent consumer can pull it in an effort to manually withdraw bill B from bill acceptor 10 after having received credit for it. Any attempted fraudulent withdrawal pulls bill B along a bill withdrawal pathway WP (as shown in FIG. 8) that is different than bill pathway 60 because it begins in second position 48 and must pass through bill security device 22. In other embodiments, the bill withdrawal pathway may be the same as bill pathway 60, but in the opposite direction.

Figure 15:
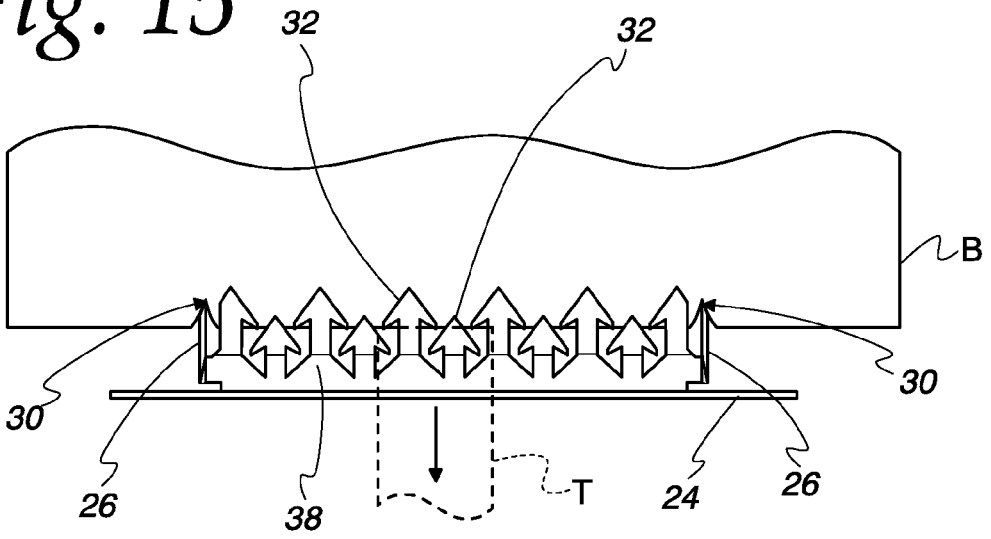
FIG. 15 is a top plan view of a bill security device in accordance with the present invention with a bill and tape included therein.

As shown in FIG. 15, as tape T unfolds from bill B, the string and tape T will pass through string cutters 32, which will cut the string and tape T that come into contact with string cutters 32. Cutting the string and/or tape T prevents the manual withdrawal of bill B by the fraudulent consumer. The present invention also provides a second line of defense, namely, bill cutters 26 with their bill-cutting edges 30. Trying to manually withdraw bill B will force bill B into bill-cutting edges 30 which can be angled to provide a perpendicular cutting surface to bill B. If bill acceptor 10 includes two cutters 26 dimensioned as disclosed herein, bill B will be sliced in two places throughout its entire length. Even if the string is not cut and the string and tape T are successfully removed, the fraudulent consumer will only receive back a central portion of bill B, preventing bill B from being used again. Advantageously, the remaining portions of bill B will remain in cash box 16, such that bill acceptor 10 will continue to operate. In this way, bill security device 22 prevents fraudulent withdrawal of a validated bill B from cash box 16.

In accordance with another aspect of the present invention, a method of mechanically accepting bills as payment from a consumer for some type of goods and/or services while preventing or reducing the likelihood of a consumer being able to obtain credit from input of a bill followed by unauthorized withdrawal of the bill is provided. The method uses a bill acceptor 10 having a bill security device 22 housed therein. Bill security device 22 includes at least one bill-cutting edge 30. In the method, bill acceptor 10 receives a bill B. Bill B is validated to give a consumer credit. Bill B is moved into first position 44 in slot 50. Bill B is then moved over bill security device 22 and into second position 48. When a fraudulent withdrawal of bill B from second position 48 is attempted, bill B is cut with the at least one bill-cutting edge 30. The method also can use a bill security device that includes at least one string-cutting surface 28 and include the step of cutting the string attached to bill B when a fraudulent withdrawal of bill B from second position 48 is attempted.

While the invention has been described with respect to certain preferred embodiments, as will be appreciated by those skilled in the art, it is to be understood that the invention is capable of numerous changes, modifications and rearrangements, and such changes, modifications and rearrangements are intended to be covered by the following claims.

What is claimed is:

1. A device for accepting bills and for preventing fraudulent withdrawal of a bill inserted by a consumer, comprising:

a cash box defining a first slot for receiving a bill, said cash box further comprising a platen, said platen positioned to receive said bill from said first slot;

a punch plate for moving said bill from a first position in said first slot to a second position closer to said platen;

a security device located between said first position and said second position, said security device having at least one string-cutting surface and at least one bill-cutting edge, wherein at least a part of said at least one bill-cutting edge is located closer to said second position than is said at least one string-cutting surface, such that on attempted fraudulent withdrawal of said bill, said at least one bill-cutting edge cuts said bill.

2. The device of claim 1 wherein when said bill is withdrawn from said second position said bill contacts said bill-cutting edge prior to contacting said string-cutting surface.

3. The device of claim 1 further comprising at least one bill cutter and wherein said at least one bill-cutting edge is on said at least one cutter.

4. The device of claim 3 wherein said at least one bill-cutting edge is angled to contact substantially perpendicularly said bill fraudulently withdrawn from said second position.

5. The device of claim 4 comprising two bill cutters, each said bill cutter including a bill-cutting edge angled to contact substantially perpendicularly said bill fraudulently withdrawn from said second position.

6. The device of claim 5 wherein said at least one string-cutting surface is positioned between said two bill cutters such that when a bill is fraudulently withdrawn from said second position and contacts said bill cutters, said at least one string-cutting surface is adjacent a portion of said bill between where said bill cutters contact said bill.

7. The device of claim 1 wherein said at least one string-cutting surface is angled away from said first position and is angled toward said second position.

8. The device of claim 7 further comprising a substantially planar string-cutter base portion integral with said at least one string-cutting surface.

9. The device of claim 8 wherein said at least one string-cutting surface comprises a plurality of string cutters angled from said string-cutter base portion.

10. The device of claim 9 wherein each of said plurality of string cutters is arrow-shaped having a point at a distal end from said string-cutter base portion.

11. The device of claim 10 wherein said plurality of string cutters are in a staggered orientation such that at least one string cutter extends further from said string-cutter base portion than a first adjacent string cutter on a first side of said at least one string cutter and further from said base portion than a second adjacent string cutter on a second side.

12. The device of claim 1 further comprising a bill acceptor attached to said cash box, said bill acceptor defining a second slot for receiving a bill.

13. The device of claim 12 wherein said first slot is substantially vertical and said second slot is substantially horizontal, said first slot and said second slot being in communication such that a bill passes from said second slot to said first slot.

14. The device of claim 1 wherein said platen is biased toward said first slot.

15. The device of claim 14 wherein said platen includes a front surface and a rear surface.

16. The device of claim 15 wherein said platen is biased toward said first slot by a spring located on said rear surface of said platen.

17. The device of claim 1 wherein said security device is positioned such that a bill moving from said first position to said second position passes over said security device.

18. A method for preventing fraudulent withdrawal of a bill from a bill acceptor after credit has been given therefor, comprising:

providing a bill acceptor having a bill security device housed therein, said bill security device including at least one bill-cutting edge;

receiving a bill in said bill acceptor;

validating said bill to give a consumer credit;

moving said bill into a first position in a slot;

from said first position, moving said bill over the bill security device and into a second position;

cutting said bill with said at least one bill-cutting edge when a fraudulent withdrawal of said bill from said second position is attempted.

19. The method of claim 18 wherein said bill security device further comprises at least one string-cutting surface and the method further comprises cutting a string attached to said bill by operation of the string cutting surface when a fraudulent withdrawal of said bill from said second position is attempted.

20. The device of claim 5 wherein said at least one string-cutting surface is bounded by said two bill cutters.

21. The device of claim 1 wherein said at least one bill-cutting edge is adapted to cut paper material.

22. The device of claim 1 wherein said at least one bill-cutting edge is adapted to cut paper-like material.

23. The device of claim 1 wherein said at least one bill-cutting edge is adapted to cut polymer material.

24. A device for accepting bills and for preventing fraudulent withdrawal of a bill inserted by a consumer, comprising:

a cash box defining a first slot for receiving a bill, said cash box further comprising a platen, said platen positioned to receive said bill from said first slot;

a punch plate for moving said bill from a first position in said first slot to a second position closer to said platen;

a security device located between said first position and said second position, said security device having at least one bill guiding surface and at least one bill-cutting edge, wherein at least a part of said at least one bill-cutting edge is located closer to said second position than is said at least one bill guiding surface, such that on attempted fraudulent withdrawal of said bill, said at least one bill guiding surface guides said bill to contact said at least one bill cutting edge and said at least one bill-cutting edge cuts said bill.

25. A device for accepting bills and for preventing fraudulent withdrawal of a bill inserted by a consumer, comprising:

a cash box defining a first slot for receiving a bill, said cash box further comprising a platen, said platen positioned to receive said bill from said first slot;

a punch plate for moving said bill from a first position in said first slot to a second position closer to said platen;

a security device located between said first position and said second position, said security device having at least one bill-cutting edge such that on attempted fraudulent withdrawal of said bill, said at least one bill-cutting edge cuts said bill.

* * * * *